US006032808A

United States Patent [19]

Henson

[11] Patent Number: 6,032,808

[45] Date of Patent: Mar. 7, 2000

[54] PORTABLE, MAILBOX-MOUNTED, POTTED PLANT HOLDER

[76] Inventor: David W. Henson, 711 Hillshire Pl., Tupelo, Miss. 38801

[21] Appl. No.: 09/220,667

[22] Filed: Dec. 24, 1998

[51] Int. Cl.[7] ..... A47F 7/00

[52] U.S. Cl. ..... 211/85.23; 211/85.31; 248/315; D6/405; 232/17

[58] Field of Search ..... 211/85.23, 85.29, 211/85.31, 71.01, 113, 119; 47/39, 41.11; 248/311.2, 312.1, 315; 232/17; D6/403, 405; 294/143

[56] References Cited

U.S. PATENT DOCUMENTS

| | | | |
|---|---|---|---|
| D. 313,105 | 12/1990 | Klahre | D11/143 X |
| D. 322,418 | 12/1991 | White | D11/144 |
| D. 410,348 | 6/1999 | Rehmert et al. | D6/405 |
| 4,757,641 | 7/1988 | Penrod | 248/315 X |
| 4,844,399 | 7/1989 | Harm | 248/311.2 |
| 5,178,321 | 1/1993 | Majewski . | |
| 5,207,378 | 5/1993 | Detchon . | |
| 5,390,443 | 2/1995 | Emalfarb et al. | 211/119 X |
| 5,711,433 | 1/1998 | Smith | 211/71.01 |
| 5,813,579 | 9/1998 | Hendrickson | 248/311.2 X |
| 5,901,998 | 5/1999 | Gallo | 294/143 |

*Primary Examiner*—Robert W. Gibson, Jr.
*Attorney, Agent, or Firm*—Kirschstein, et al.

[57] ABSTRACT

An open framework is supported on a mailbox and, in turn, supports multiple flowerpots whose plants decorate the mailbox. The framework and the flowerpots are removable as a unit. The flowerpots are individually removable. The framework includes a plurality of rings for supportably engaging the flowerpots.

13 Claims, 3 Drawing Sheets

PORTABLE, MAILBOX-MOUNTED, POTTED PLANT HOLDER

BACKGROUND OF THE INVENTION

1. Field of the Invention

This invention generally relates to decorating a mailbox and, more particularly, to removably holding potted plants adjacent the mailbox.

2. Description of the Related Art

Stand-alone, curb-side, mailboxes positioned adjacent a street have long been decorated by residents desiring to beautify the uniform, dull, institutional appearance of standard, regulation mailboxes approved by the U.S. Postal Service. Typically, the flat side surfaces of the mailboxes facing the street are painted or covered with pictures. Sometimes, decorative covers, such as disclosed in U.S. Pat. Nos. 5,178,321 and 5,207,378, are placed over the mailboxes. In a more individualistic vein, the mailbox itself is configured with a unique construction resembling a miniature house, animal, or thing, oftentimes representing a vocation or avocation of the resident.

For those residents who enjoy gardening, a plot of land around the mailbox is cultivated with plants. The resulting greenery screens the mailbox from view. U.S. Design Pat. Nos. D-313,105 and D-322,418 combine the aspect of covering a mailbox with the aspect of providing greenery adjacent the mailbox by integrating planter boxes with a mailbox-mounted cover.

As aesthetic as these combination planter box-covers are, experience has shown that they have not proven altogether satisfactory in use. Plants require care. A plant requiring care must be dug out of a dirt bed in the planter box, transported to and returned from a nursery, and then replanted, or another plant is substituted. In preparation for cold weather, such planter box-covers must be removed from the mailbox, usually with the dirt-filled beds intact. The increased weight of the dirt-filled beds causes the removal to be difficult, especially for elderly residents.

SUMMARY OF THE INVENTION

OBJECTS OF THE INVENTION

Accordingly, it is a general object of the present invention to decorate a mailbox with potted plants, especially flowerpots.

More particularly, it is an object of the present invention to provide a potted plant holder with flowerpots that are easily and individually removable for rendering care to the plant.

Still another object of the present invention is to enable the potted plant holder to be easily removable from the mailbox.

A concomitant object of the present invention is to provide a potted plant holder that is rugged to withstand the environment, and attractive to ornament the mailbox with a unique appearance.

FEATURES OF THE INVENTION

In keeping with these objects and others which will become apparent hereinafter, one feature of this invention relates to a holder for holding at least one flowerpot, and preferably a plurality of flowerpots, adjacent at least one side, and preferably at both sides, of a mailbox, typically a stand-alone, regulation mailbox approved by the U.S. Postal Service.

In the preferred embodiment, the holder is a one-piece framework constituted of a tubular metal treated to withstand the environment, especially resistant to rust due to exposure to water and light. The holder includes a main portion supported by the mailbox and straddling the opposite sides of the mailbox, and at least one suspension portion, and preferably a pair of suspension portions, connected to the main portion. Each suspension portion supportably engages a sidewall of at least one flowerpot, and preferably a plurality of flowerpots in a pair of rows extending lengthwise of the mailbox.

More specifically, the main portion includes a pair of generally U-shaped frame elements spaced apart along a longitudinal direction and straddling the opposite sides of the mailbox. Each frame element has an upper bight section extending along a curve over a top of the mailbox, and a pair of linear sections extending generally vertically downwardly away from a respective bight section. The lower ends of the linear sections are interconnected by a pair of inner connecting sections linearly extending in mutual parallelism along the longitudinal direction.

Each suspension portion includes a plurality of rings spaced successively along the longitudinal direction and lying in a common generally horizontal plane. The rings are tangentially connected to a respective inner connecting section of the main portion, and are also tangentially connected to an outer connecting section that is spaced transversely away from the respective inner connecting section. Each outer connecting section is separately connected at opposite ends to the main portion for increased rigidity.

Each ring has a ring diameter for encircling a respective sidewall and supportably holding the respective flowerpot in an upright orientation. When the flowerpot has an annular flange having a predetermined diameter, the ring diameter is selected to be smaller than said predetermined diameter so that the ring supports the flange from below and prevents the flowerpot from falling to the ground.

A handle portion is connected between the bight sections and extends along the longitudinal direction. A jog in the handle portion enables a user to fit his or her hand between the jog and the mailbox, thereby enabling the user to grip the jog and lift the holder for transport to a location remote from the mailbox, typically in preparation for winter storage.

Each flowerpot is individually removable from its supporting ring by being lifted upwardly. There are no dirt beds to dig up at the site of the mailbox. Each plant can be cared for with no disruption to the other plants.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
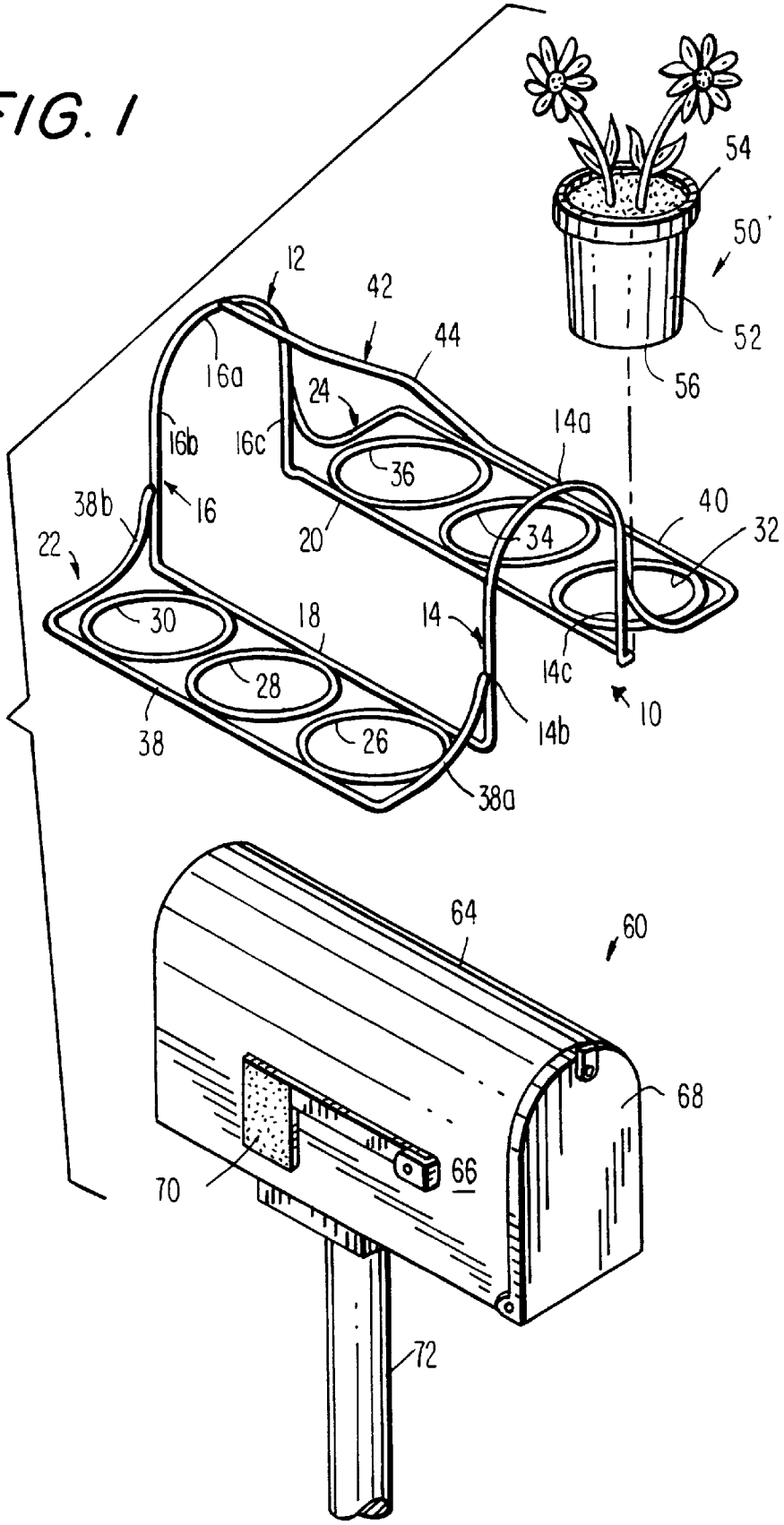
FIG. 1 is an exploded, perspective view of a mailbox, a holder in accordance with this invention to be mounted on the mailbox, and a representative flowerpot to be supported on the holder.

Referring now to FIG. 1, reference numeral 10 generally identifies a holder according to this invention. The holder 10 is operative for holding at least one flowerpot 50 adjacent a mailbox 60 to adorn the same.

The mailbox 60 has a standard construction regulated and approved by the U.S. Postal Service and includes, as is conventional, a flat bottom wall 62 (see FIG. 3), a generally semi-cylindrical enclosure 64 having generally flat opposite sides 66 that face the street in opposite directions, and a front door 68 pivotably mounted on the enclosure and openable for the deposit and removal of mail, and closeable to shut the enclosure. A flag 70 is pivotable on one of the sides 66 and is raised or lowered, as desired, to alert a mail carrier or a resident to the presence or absence of mail.

The mailbox 60 is mounted adjacent the street at the curb on a post 72 which is illustrated as being centrally positioned underneath the mailbox. The post 72 could also be positioned behind the mailbox, in which case, a support arm extends forward and supports the bottom wall 62 from below.

The illustrated flowerpot 50 is merely representative of various containers typically used for growing plants. Preferably, the container is a frusto-conical pot with a circular sidewall 52 extending completely around the periphery of the pot. The diameter of the sidewall 52 increases in an upward direction away from a base 56 of the pot. The sidewall 52 has a circular flange 54 having a predetermined diameter greater than that of the sidewall 52. Dirt is contained in the pot. A plant is placed in the dirt to grow. In some cases, an artificial plant can be placed in the dirt and, if desired, a foam insert can be substituted for the dirt.

Other flowerpot configurations are contemplated for this invention. Rather than the illustrated circular sidewall 52, the flowerpot can have a generally square sidewall with rounded corners. The flange 54 can be eliminated. Drain holes can be provided anywhere near the bottom of the pot, that is, thru the base 56 or through a lower region of the sidewall.

The holder 10 includes a main portion 12 having a pair of inverted, generally U-shaped frame elements 14, 16 spaced apart along a longitudinal direction lengthwise of the mailbox. Frame elements 14, 16 have upper curved bight sections 14*a*, 16*a*, and generally linear sections 14*b*, 16*b* and 14*c*, 16*c*, respectively, extending downwardly from the bight sections 14*a*, 16*a*. In use, when the main portion 12 is positioned on the mailbox 10, the bight sections 14*a*, 16*a* engage and extend along a curved top of the mailbox. The linear sections 14*b*, 16*b* engage and extend along one of the sides 66 of the mailbox, while the linear sections 14*c*, 16*c* engage and extend along the other of the sides 66 of the mailbox.

The main portion 12 further has a pair of inner connecting sections 18, 20 generally linearly extending in mutual parallelism between the frame elements 14, 16 along the longitudinal direction. Connecting section 18 connects the lowermost ends of linear sections 14*b*, 16*b*. Connecting section 20 connects the lowermost ends of linear sections 14*c*, 16*c*. The inner connecting sections 18, 20 provide overall rigidity to the holder and maintain the frame elements 14, 16 in alignment.

The holder further includes a pair of suspension portions 22, 24 connected to the main portion 12 and extending in opposite directions transverse to the longitudinal direction away from the opposite sides 66 of the mailbox. Suspension portion 22 includes a plurality of rings 26, 28, 30 successively arranged along a first longitudinal row. Suspension portion 24 includes a plurality of rings 32, 34, 36 successively arranged along a second longitudinal row parallel to the first row. Although three rings are illustrated for each row, any number of rings will suffice. Moreover, although two suspension portions are illustrated, a single suspension portion is also within the scope of this invention.

Figure 6:
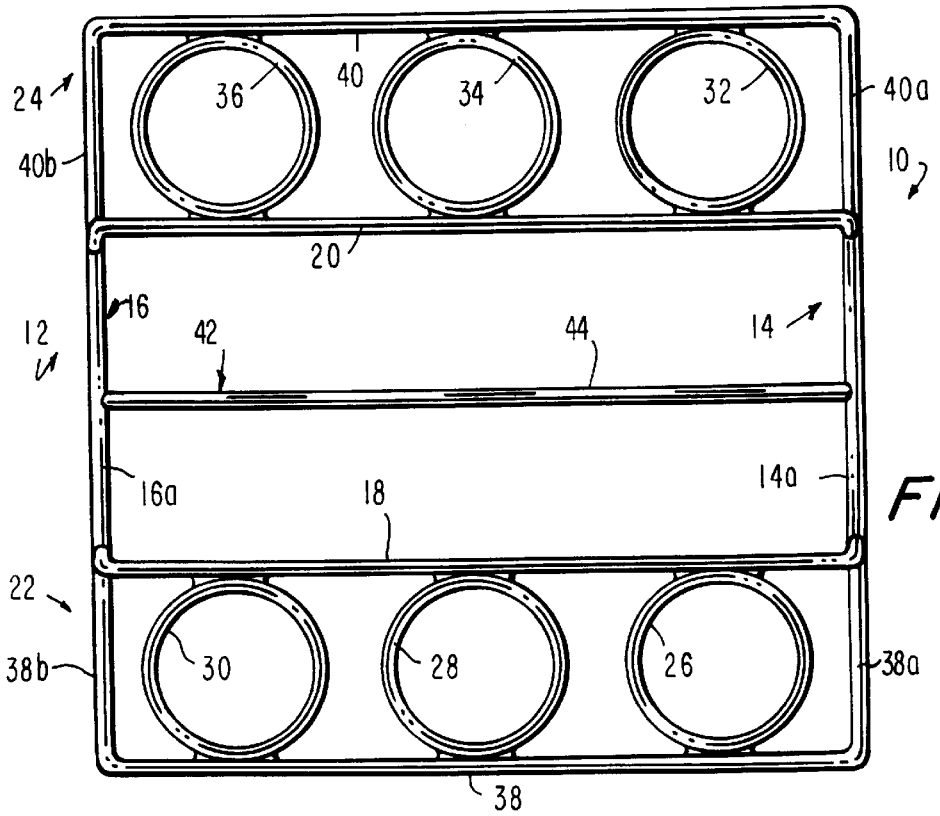
FIG. 6 is a top plan view of the holder.

Suspension portions 22, 24 include a pair of outer connecting sections 38, 40 generally linearly extending in mutual parallelism outwardly of the inner connecting sections 18, 20. As best seen in FIG. 6, the rings 26, 28, 30 are tangentially connected to and between the inner and outer connecting sections 18, 38. The rings 32, 34, 36 are tangentially connected to and between the inner and outer connecting sections 20, 40. The ends of the outer connecting section 38 are connected by curved cross arms 38*a*, 38*b* to the frame elements 14, 16. The ends of the outer connecting section 40 are connected by curved cross arms 40*a*, 40*b* to the frame elements 14, 16.

The holder still further includes a handle portion 42 connected to the frame elements 14, 16. The handle portion extends along the longitudinal direction and has a central jog 44 that extends upwardly along a curved arc and serves as a grip or handhold by which the holder is carried, and lifted and lowered into position relative to the mailbox.

The illustrated holder is a skeletal open framework of one-piece construction. Preferably, a tubular metal is used and the connections between the various sections are welds. The metal is preferably painted or treated to resist corrosion and weathering. Other materials, for example, synthetic plastic, could be employed. The open framework enables the mailbox door 68 to be opened and closed, as well as the flag 70 to be raised and lowered, without mechanical interference.

Figures 2, 3:
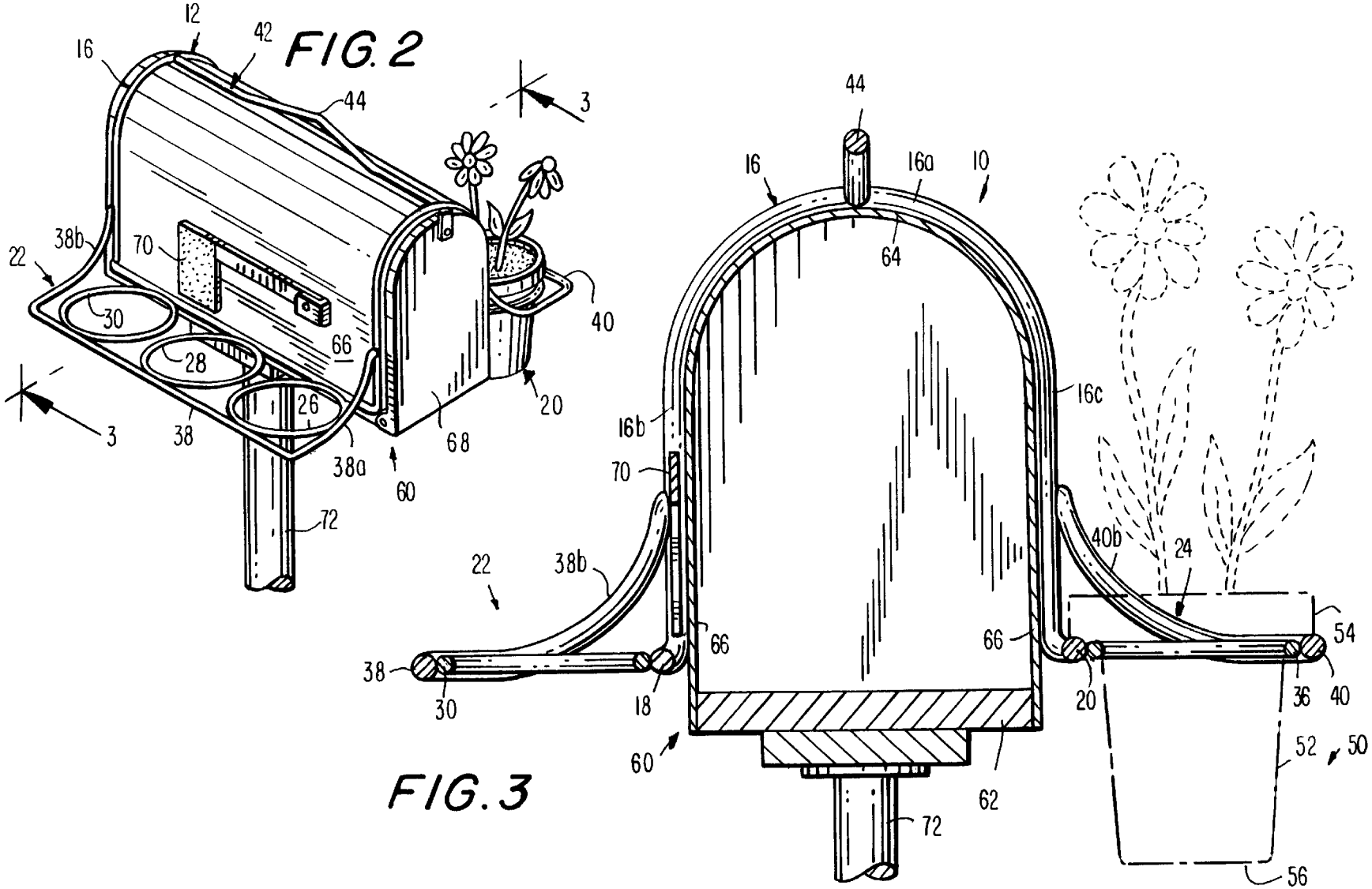
FIG. 2 is a perspective view of the potted plant holder of FIG. 1 during use.
FIG. 3 is a sectional view taken on line 3—3 of FIG. 2.
Figure 4:
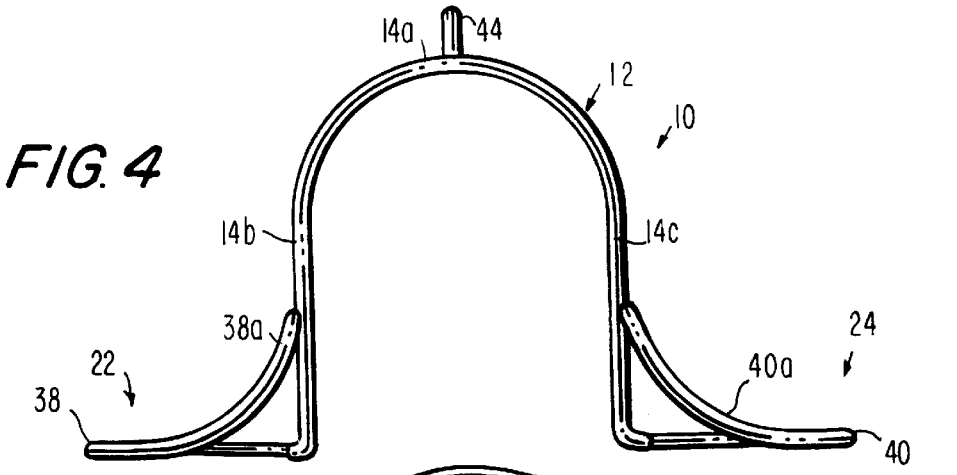
FIG. 4 is a front elevational view of the holder.
Figure 5:
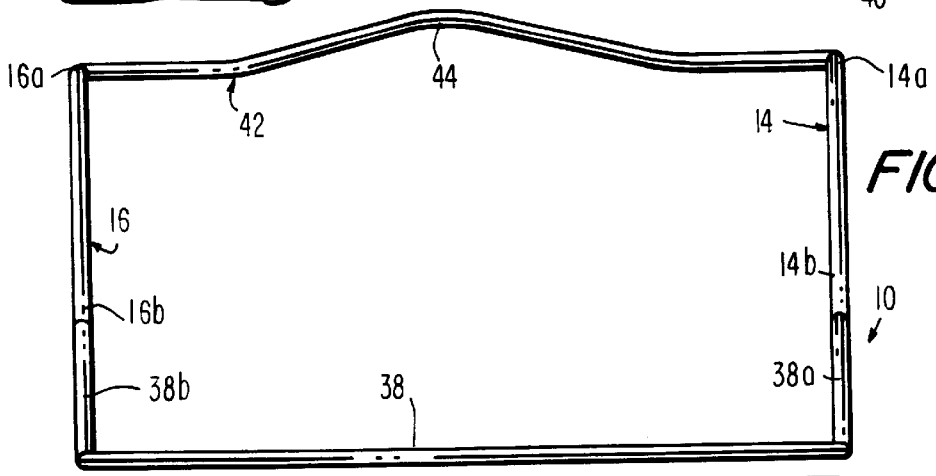
FIG. 5 is a side elevational view of the holder.

Each ring has a ring diameter dimensioned to encircle a respective sidewall 52 of the flowerpot 50 in order to suspendably hold the flowerpot in an upright orientation. It will be recalled that the illustrated flowerpot has a frusto-conical shape whose circular cross-section decreases toward the base 56. A flowerpot inserted into a ring will descend until the ring diameter matches the pot diameter. Preferably, as shown in FIG. 3, the pot is provided with the flange 54 whose diameter is greater than that of the ring diameter so that the pot descends until the underside of the flange abuts against the ring. Even so, the presence of the flange 54 is not strictly necessary depending on the choice of ring and pot diameters.

Also, rather than providing circular rings, differently configured elements can be used for supportably holding a pot. For example, a pair of transversely spaced elements can support a pot therebetween, or a triangular or other polygonal arrangement of elements can hold the pot. In the case where the pot has other than a circular cross-section, such other configured elements may be preferred. The pot holding elements need not be circumferentially complete, but can be split rings, for example.

The pots are individually positioned in, and individually removable from, the rings, either before and/or after the holder 10 is mounted on the mailbox. Any individual plant can be removed and cared for without digging up established dirt beds. The overhead grip 44 conveniently allows the holder and all the pots to be transported simultaneously. The plants growing out of the pots screen the sides 66 of the mailbox and improve its aesthetic appearance to passersby.

It will be understood that each of the elements described above, or two or more together, also may find a useful application in other types of constructions differing from the types described above.

While the invention has been illustrated and described as embodied in a portable, mailbox-mounted, potted plant holder, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claims:

1. A holder for holding a flowerpot having a sidewall extending around a periphery of the flowerpot adjacent a mailbox having opposite sides, the holder comprising:

a) a main portion supported by the mailbox and having a pair of inverted generally U-shaped frame elements spaced apart along a longitudinal direction and straddling the opposite sides of the mailbox during use;

b) a suspension portion connected to the main portion and extending away from one of the sides of the mailbox, for supportably engaging the sidewall and removably suspending the flowerpot during use; and c) an overhead handle portion extending along the longitudinal direction and connected between the U-shaped frame elements.

2. The holder according to claim 1; and further comprising another suspension portion connected to the main portion and extending away from the other of the sides of the mailbox, for supportably engaging the sidewall of another flowerpot and removably suspending the other flowerpot during use.

3. The holder according to claim 1, wherein the suspension portion includes a ring for encircling the sidewall.

4. The holder according to claim 3, wherein the sidewall has an annular flange having a predetermined diameter, and wherein the ring has a ring diameter smaller than said predetermined diameter to hold the flange from below the flange.

5. The holder according to claim 1; and further comprising a plurality of auxiliary suspension portions identical to the first-mentioned suspension portion, for removably suspending a corresponding plurality of the flowerpots.

6. The holder according to claim 2; and further comprising a plurality of supplementary suspension portions identical to said other suspension portion, for removably suspending a corresponding plurality of the flowerpots.

7. The holder according to claim 1, wherein the main portion and the suspension portion are interconnected in a one-piece framework.

8. The holder according to claim 1, wherein the handle portion has two linear elements and a jog between the linear elements.

9. The holder according to claim 1, wherein each U-shaped frame element has an upper bight section extending along a curve over a top of the mailbox, and a pair of linear sections extending generally vertically downwardly away from a respective bight section.

10. A holder for holding a plurality of flowerpots, each having a sidewall extending around a periphery of a respective flowerpot, adjacent a stand-alone mailbox having opposite sides, the holder comprising:

a) a main portion supported by the mailbox and straddling the opposite sides of the mailbox during use;

b) a pair of suspension portions connected to the main portion and extending in opposite directions away from the opposite sides of the mailbox, for supportably engaging respective sidewalls of the flowerpots and removably suspending the flowerpots during use; and c) a handle portion extending lengthwise of the mailbox, and including an overhead jog for enabling the holder to be transported.

11. The holder according to claim 10, wherein each suspension portion includes a plurality of rings for encircling the respective flowerpots.

12. A holder for holding a plurality of flowerpots, each including an annular sidewall having an annular flange extending around a periphery of a respective flowerpot, adjacent a stand-alone mailbox having opposite sides, the holder comprising:

a) a main portion supported by the mailbox and having a pair of inverted generally U-shaped frame elements spaced apart along a longitudinal direction and straddling the opposite sides of the mailbox during use;

b) a pair of suspension portions connected to the main portion and extending in opposite directions along a generally horizontal plane away from the opposite sides of the mailbox, each suspension portion including a plurality of rings for encircling the respective flowerpots and supportably engaging the respective flanges from below the respective flanges, said rings of each suspension portion being arranged in a respective row along the longitudinal direction; and c) a handle portion connected in a one-piece construction to the main portion and the suspension portions and extending generally along the longitudinal direction, for enabling the holder to be transported.

13. The holder according to claim 12, wherein the portions are constituted of a tubular metal framework.

* * * * *